US007039486B2

(12) United States Patent
Wang

(10) Patent No.: US 7,039,486 B2
(45) Date of Patent: May 2, 2006

(54) METHOD AND DEVICE FOR VIEWING, ARCHIVING AND TRANSMITTING A GARMENT MODEL OVER A COMPUTER NETWORK

(76) Inventor: Kenneth Kuk-Kei Wang, House 6, Green Villa, Lot251 DD223, 7-1/2M Clearwater Bay Road - Sai Kung, Kowloon (HK)

( * ) Notice: Subject to any disclaimer, the term of this patent is extended or adjusted under 35 U.S.C. 154(b) by 0 days.

(21) Appl. No.: 10/508,680

(22) PCT Filed: Mar. 24, 2003

(86) PCT No.: PCT/IB03/01685

§ 371 (c)(1),
(2), (4) Date: Sep. 22, 2004

(87) PCT Pub. No.: WO03/079836

PCT Pub. Date: Oct. 2, 2003

(65) Prior Publication Data

US 2005/0154487 A1 Jul. 14, 2005

(30) Foreign Application Priority Data

Mar. 22, 2002 (FR) ..... 02 03644

(51) Int. Cl.
*G06F 19/00* (2006.01)
*A41H 1/00* (2006.01)

(52) U.S. Cl. ..... 700/117; 700/132; 345/630; 33/512

(58) Field of Classification Search ..... 700/117, 700/132; 705/26; 345/419, 420, 630; 33/512
See application file for complete search history.

(56) References Cited

U.S. PATENT DOCUMENTS

| | | | | |
|---|---|---|---|---|
| 4,885,844 A | 12/1989 | Chun | ..... | 33/15 |
| 6,404,426 B1 * | 6/2002 | Weaver | ..... | 345/419 |
| 6,546,309 B1 * | 4/2003 | Gazzuolo | ..... | 700/132 |

FOREIGN PATENT DOCUMENTS

| | | |
|---|---|---|
| GB | 861972 | 3/1961 |
| WO | WO 01/63932 | * 8/2001 |
| WO | 02/093449 | 11/2002 |

* cited by examiner

*Primary Examiner*—Leo Picard
*Assistant Examiner*—Steven R. Garland
(74) *Attorney, Agent, or Firm*—William H. Holt

(57) ABSTRACT

A method and device for viewing, archiving and transmitting a garment model over a computer network. The method comprises photographing a physical mannequin from several different directions, the mannequin being a copy of a virtual human model which is representative of the target consumer. The virtual mannequin viewing layers and the garment model are generated from digital images of the naked or clothed mannequin which is suspended from the photography stand. A laser beam is used to determine the exact position of the mannequin. Subsequently, crop marks and recorded reference lines can be used to merge the viewing layers and the model precisely. The data are archived in a base and transmitted over an intranet, an extranet or the Internet for the purpose of remote viewing. The method and device are particularly suitable for the design, manufacture and inspection of clothing samples in the clothing industry.

36 Claims, 4 Drawing Sheets

METHOD AND DEVICE FOR VIEWING, ARCHIVING AND TRANSMITTING A GARMENT MODEL OVER A COMPUTER NETWORK

The present invention relates to a method and device for viewing, archiving, and transmitting a garment model over a computer network and the use thereof.

TECHNICAL BACKGROUND TO THE INVENTION

Attempts have long been made to rationalise the process of garment manufacture by using more and more sophisticated technical equipment.

British patent GB861.972, published on 1 Mar. 1961 in the name of A. LEVY shows how the traditional measuring by a tailor of the person who is to wear the garment can be replaced by a photographic session. At least 3 photographs of the person standing on a pivoting platform are taken in at least three different directions in front of a white background marked with perpendicular lines. A motor drives the platform, and the shutter of the camera and the lighting are synchronised with this rotation.

The device disclosed in U.S. Pat. No. 4,885,844, published on 12 Dec. 1989 in the name of J. CHUN, is based on a similar principle but makes more use of the possibilities of digital processing of the signals from the video camera used. The person wears a set of bands constituting a mesh, the image of which is converted by a computer into a "wire mesh" representation of the body. These data are transmitted by telecommunication means to a remote manufacturing workshop and control an adjustable mannequin on site. Consequently the workshop has a true copy of the body of the person in order to adjust the garment.

More recently, other methods and systems have made use of the developments in the technology of synthetic imaging in order to create a virtual mannequin from data selected from a morphological databank and corresponding to a particular profile.

One approach of this kind is described in international patent application PCT/EP01/05480 filed on 11 May 2001 in the name of the applicant of the present application. The key parameters of categorising the human body profile (ethnic group, sex, stature, weight, measurements, attitude, and posture of the body) stored in the database are retrieved following a morphological search directed to the target population.

Virtual reality techniques applied to the field of clothing make it possible nowadays to create a veritable "virtual changing room".

U.S. Pat. No. 5,850,222, published on 15 Dec. 1998 in the name of D. CONE, describes in particular a method and system for merging the data representing a three-dimensional human body model obtained from a standard model stored in a database and produced from the measurements of a person, with the data representing a two-dimensional garment model. The measurements can be transmitted by electronic mail. The result is a simulation of the person wearing the garment on the computer screen.

The method and device described in international patent application WO 00.77744 in the name of the company ZENIMAX MEDIA, published on 21 Dec. 2000, attempt to take a further step into realism as the virtual mannequin wearing the garment is animated and is able to move in several types of environment such as a discotheque, a beach, etc., so that it is possible to judge the effect of the garment on the person in these situations. The system may be installed on a local computer or on a central computer which is accessible by multiple users via a communication network such as the internet. Garment models appearing in a catalogue may be transmitted periodically to the customer.

However, the various known methods and systems for computer viewing of a garment have at least two limitations:

a) the oldest of them offer limited interactivity, b) The more recent ones are simulations produced entirely by software which may therefore be somewhat lacking in realism.

The device described in U.S. Pat. No. 4,885,844 makes it possible to automatically create a real mannequin on which the garment is tried out; the realism is therefore perfect. However, it is not possible to have an exchange of opinions as to the fit of the garment with its intended wearer, who is not on site.

The systems described in U.S. Pat. No. 4,885,844 and WO00.77744 are totally interactive but do not appear to have any means for perfectly simulating the wearing of the garment by the virtual mannequin.

It is therefore apparent from the documents cited above that methods and devices for viewing, storing, and transmitting a garment model over a computer network are known from the prior art. However, they do not appear to offer all the desired characteristics to enable them to be used in a context of designing and manufacturing garment models on a large scale requiring the use of a number of actors which are very demanding in a competitive environment.

GENERAL DESCRIPTION OF THE INVENTION

The present invention consequently sets out to enable all the parties concerned along the "garment supply chain" such as the designers, merchandisers, agents, sourcing offices, manufacturers, material suppliers, to effectively communicate essential information relating to the creation and selection process, producing prototypes and manufacturing them, the key technical and visual quality points, retail costs and target prices on the basis of a unique and identical visualisation which is translated and transmitted via any intranet, extranet, or internet communication network.

It relates more precisely to a method of viewing, storing, and transmitting a garment model over a computer network, of the type consisting of:

a) acquiring on a first computer system a three-dimensional view of a specific human mannequin (SHM) having predetermined morphological features, extracting from this three-dimensional view first data for categorising the human physical profile, and storing them, b) alternatively extracting these first data from a databank in a second computer system, c) generating, on a third computer system, second data representing a three-dimensional specific virtual mannequin (SVM) from said first data, d) automatically manufacturing, from said second data, using a fourth computer system, a specific physical mannequin (SPM).

The process according to the present invention is notable in that it consists in acquiring, from a fifth computer system, a first view of the specific SPM and representing it by means of third data corresponding to this first view.

The second essential feature of the process according to the invention is that it also consists in acquiring from the fifth computer system a second view of the specific physical mannequin (SPM) wearing the garment and representing the whole by fourth data corresponding to this second view.

An additional feature of the process according to the invention is that the second data are personalised on a sixth computer system using visual characteristics, preferably comprising the type and colour of the hair and skin, in order to obtain fifth data representing a three-dimensional specific virtual "fashion" mannequin (SVFM).

Particularly advantageously, the first and second views consist of a plurality of two-dimensional images of the SPM in different regularly spaced radial directions, preferably twelve directions.

Preferably, the images of the SPM comprise recording grid reference points for taking views at a fixed distance.

Advantageously, these images also comprise recordings of vertical and horizontal reference lines.

It is useful to record spatial positioning signals of the specific physical mannequin at the same time as acquiring the first and second views.

According to the invention the first two-dimensional base layer of the visualisation of the garment model is extracted from the sixth computer system of the first view, i.e. from the view of the naked SPM.

Advantageously, the second two-dimensional base layer of this visualisation is also generated from the sixth computer system starting from the fifth data representing the SVFM by simulating a view taken in the radial directions in question.

According to the invention, the first base layer of the display is subtracted from the sixth computer system by means of the reference points, lines or signals of the fourth data representing the clothed SPM to form the two-dimensional model of the garment, in each of these directions.

Advantageously, the first and second base layers and the garment model are transmitted to a seventh computer by means of a data transfer network according to a pre-determined communication system, preferably TCP/IP for the purpose of displaying the model shown on the SVFM or the SVM.

An additional feature of the process according to the invention is that the model is merged by means of the reference points, lines or signals on said sixth or seventh computer system with the second layer in order to have a two-dimensional view, in each of the radial directions, of a clothed SVFM intended for the assessment of the garment.

Preferably, the model is processed on the sixth or seventh computer system in order to show, as a transparency, the second layer of display.

Advantageously, the first and second layers and the model are stored in a data base on an eighth computer system which is accessible by means of a data transfer network in accordance with a predetermined communication system, preferably TCP/IP, for the purpose of displaying the model shown on the SVFM or SVM.

Preferably, each recording of this data base is associated with at least one recording of a first, second, third and fourth file, preferably of the type "material", "accessories", "manufacture", and "patterns".

Particularly advantageously, a plurality of garment models corresponding to the same SVM are displayed layer by layer with any desired degree of transparency.

In order to carry out the process described above, a device for viewing, storing, and transmitting a garment model over a computer network comprises, in known manner:

a) A system for three-dimensional digitisation of a specific human mannequin (SHM) connected to a first computer system,
b) first processing means and first storage means associated with said first computer system, for the purposes of extracting and storing first data for categorising the human body profile relating to the SHM,
c) alternatively, second processing means and second storage means associated with a second computer system, for the purpose of extracting the first data from a databank,
d) the third processing means and third storage means associated with a third computer system for the purpose of generating the second data representing a specific virtual mannequin (SVM),
e) a digitally controlled system for manufacturing three-dimensional objects connected to a fourth computer system equipped with fourth processing means and fourth storage means, for the purpose of manufacturing a specific physical mannequin (SPM) from the second data.

The device according to the invention further comprises a system for taking digital views recording images of the SPM naked or wearing the garment. This system for taking views is connected to a fifth computer system equipped with fifth processing means and fifth storage means for the purpose of representing the SPM naked or clothed, by third and fourth data, respectively, corresponding to the images recorded.

Preferably, the system for taking views comprises grid reference points in the plane of the SPM.

The apparatus according to the invention makes use of a system for taking views comprising a detector for detecting the position of a light beam emitted by a light source, preferably a laser diode, fixed to the SPM, preferably to a foot.

An additional feature of the apparatus according to the invention is that the view-taking system comprises a means of orienting the SPM in a number of regularly spaced radial directions, preferably twelve. The orienting device comprises a notched disk preferably having twelve notches and a locking member engaging in one of the notches.

Advantageously, the view-taking system comprises a fixed-focus digital photography apparatus preferably provided with a matrix CCD sensor.

The apparatus for viewing, archiving, and transmitting a garment model over a computer network according to the invention also comprises:

a) a sixth computer system provided with sixth processing means, sixth storing means, viewing means and transmission means capable of processing and storing the second, third and fourth data for the purposes of generating, viewing and transmitting a two-dimensional model of the garment, and the viewing layers of the SVM and of a clothed specific virtual fashion mannequin (SVFM) with a variable degree of transparency,
b) a seventh computer system provided with receiving means, seventh processing means, seventh storing means and display means for the purpose of receiving this model and the viewing layers, displaying the model, and generating and displaying the SVM and the clothed SVFM with a variable degree of transparency,
c) an eighth computer system provided with communication means, eighth processing means, and eighth storing means, for the purpose of receiving, transmitting, and archiving a plurality of this model and the viewing layers associated with complimentary data files, preferably of the type "material", "accessories", "manufacture", and "patterns",
d) a data transfer network connecting the sixth, seventh and eighth computer systems, preferably a network using the TCP/IP system, notably the internet.

Advantageously, access to the contents of the storage means is controlled by security means, preferably of the "password" type or cryptographic type.

These essential specifications will demonstrate to the skilled man the advantages conferred by the method and apparatus according to the invention for viewing, archiving, and transmitting a garment model over a computer network, compared with the prior art, notably:

a) the availability of a faithful representation of the body profile of the target consumer:

The use of specific physical mannequins (SPM) for the parametric profiles and key dimensional measurements agreed between the parties (essentially the designer and the merchandisers) as being perfectly representative of the specific human mannequin (SHM) of the designer and the extrapolations of the range of sizes of the target market, b) a tool which allows the dimensional measurements to be monitored and the positioning of the garment under examination to be ensured:

The response is found in the use of a technology which allows all the parties to be absolutely sure that when the mannequin used as standard is dressed with the sample garment which is to be examined, the essential measurements characteristic of a size can be checked easily and reliably and the verification of the correct positioning of the garment on the mannequin with regard to the main points of construction (system of reference lines visible on the mannequin and adapted to be displayed through all the other layers once they have been superimposed), c) a tool which makes it possible to ensure the functional comfort of the garment being examined:

The possibility of checking, for any key point, the "comfort and functional capacities of easy wear" of the model under examination, particularly by simultaneous display on a screen window of the dimensional measurements of the naked body of the mannequin (SPM) or those of the virtual mannequin (SVM), in relation to the corresponding measurements of the garment, d) a communication tool between the parties in the garment supply chain:

The use of multi media technology in the display combined with internet-intranet-extranet transmission, irrespective of the location and distance by the different parties involved, retaining total interactivity in the intercommunication every time that changes are needed to the developmental samples of the garment, e) an inspection tool used as a "standard platform" to assist in the quality control of mass-produced products:

The possibility of using this display and communication system as a sole identical basis for trying out, on which garments mass produced from the prototype originally approved can be monitored according to a process and requirements which are strictly identical, f) a tool for monitoring and recording communications:

The possibility of monitoring and recording all the interactions and exchanges throughout the product design/production chain, g) a market research tool:

The possibility of using the prototype sample shown on the SVM or SVFM via the internet as a test medium with consumers and as a marketing tool and a selling tool in the shops, h) a tool which is compatible with the other systems currently in use in the management of the garment supply chain:

The possibility of integrating the method and apparatus according to the invention with any other computer-based logistical system throughout the "clothing" supply chain.

The combined features of the invention should totally improve the essential step of "definition and acceptance of product samples and products in the course of industrial manufacture", in the clothing supply chain, before the passing of the mass-production orders, thereby assuring, as the main effects, speed, interactivity, and implementation of the first stage of the operation without any errors, a reduction in costs, quality assurance, and a better matching of supply and demand (by the marketing tests).

DESCRIPTION OF A PREFERRED EMBODIMENT OF THE INVENTION

Figure 1:
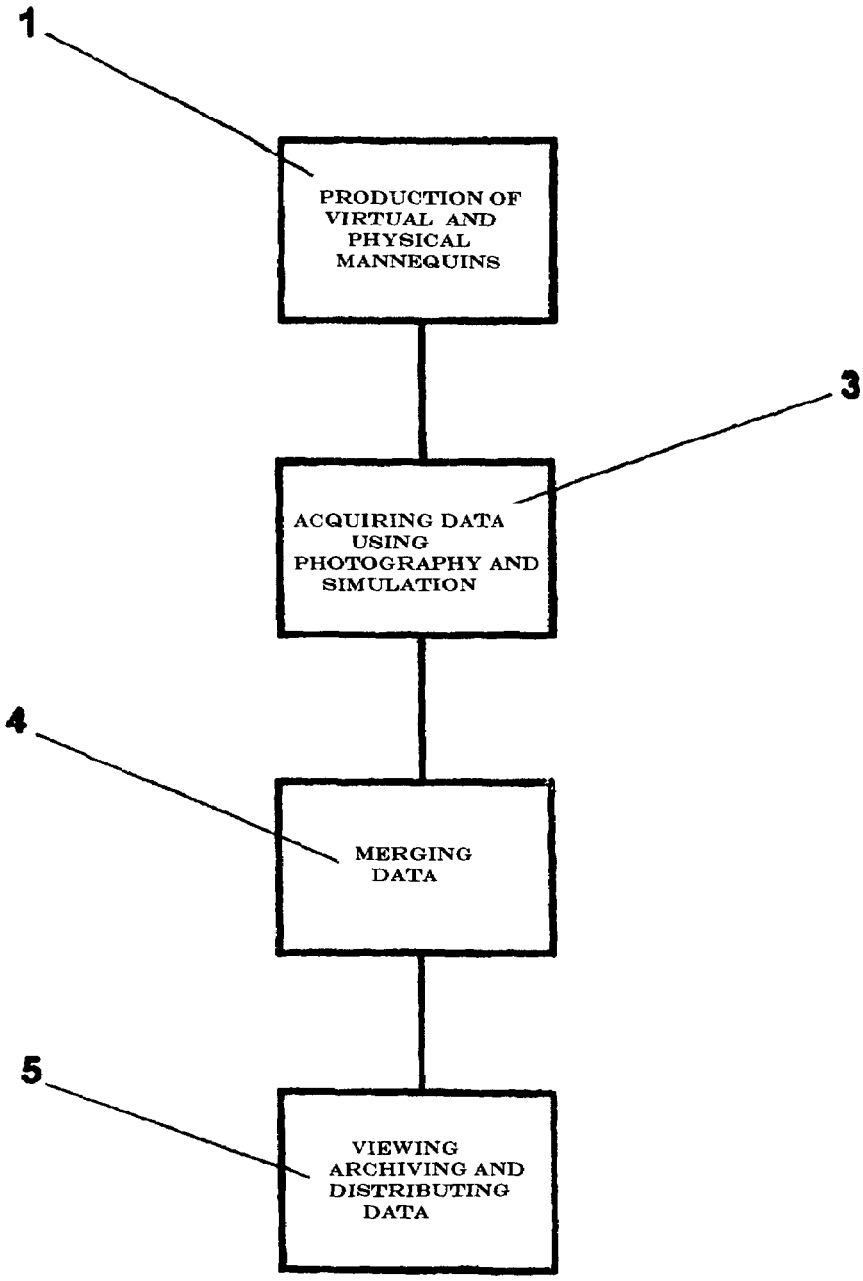
FIG. 1 diagrammatically shows the four main steps of the process according to the invention.

The invention constitutes overall an interactive integrated system which proposes tools for viewing, organising and communicating appropriate information relating to the. construction, measurements, fit, manufacture of an order relating to a specific model of a garment label, and which is based on the provision of the photographic or virtual image of this specific garment being worn by the specific human mannequin (SHM) used by the designer or the specific virtual mannequin (SVM) of this same outline.

The conventional method of manufacturing garments is still generally used by the various parties involved, nationally or internationally, throughout the clothing supply chain. The designer creates his or her garment models based on his or her own ideas or on the style and component specifications indicated by the product managers. The prototype sample manufactured and the technical file of specifications and costs are then physically sent to the other parties to obtain their agreement or comments and, eventually, their approval of the style. This may give rise to a number of modifications and discussion back and fourth before their full agreement is obtained. Even then, the alterations may lack precision and compromise the nature of the product and its qualitative requirements owing to the fact that the key steps are not carried out under strict conditions: the garments have not been tried out on the right mannequins to discuss the sample. Because the same bodies and measurements have not been used by the different parties involved, this leads to delayed reaction, imprecise statements, and incorrect perceptions which result in lengthy delays and increased costs resulting from the multiplicity of samples needed.

The new communications technology already in use has allowed a better approach to be taken to this conventional practice by the use of video conferencing which allows all the interested parties to examine the sample prototype being modelled by a standard mannequin and to give their comments and make alterations independently of their distance.

However, simple video conferencing still lacks precision because it is not based on a viewing of the sample garment being worn by a mannequin regarded by the manufacturer's label as being perfectly representative of the consumers in the target market. Moreover, the video conferencing approach requires the mobilisation of all the parties involved simultaneously, in real time, which may be difficult when it is not absolutely essential. With the latest technology using the garment viewing system (GVS) perfected by the present applicant, all the parties involved can examine the sample being modelled by the mannequin designed by the designer, give their comments and requests for alterations irrespective of the location and time (the communication may be slightly delayed and still be "interactive" provided that the system provides a strict procedure and record to prevent errors of duplication or omission while providing a record and a basis for exchanges through email or through intranet, extranet or internet circuits).

However, some essential problems still remain concerning the "standard design mannequin". This "standard" may be slightly different from the outline and measurements of those of the specific target consumer for whom the garments are designed. This is all the more so and all the more difficult when the various parties involved want to ensure the "correct fit" of a particular size in the range or to check the correct adjustment of the fit of a certain model which is to be distributed to a worldwide market, involving different body profiles. Another difficult point arises from the fact that the majority of garments are worn by the consumer on top of one another. This means that the checking of the fit of the prototype sample must take account of the interaction of the different layers with one another. An absolute assurance that each garment will be correctly positioned on the replica of the specific mannequin without any deformation of dimensions, size, posture, and attitude will provide a certainty of "good fit", comfort and ease of wearing for the final consumer. All these important facts are dealt with by taking into account the materials and styles, tight fitting or loose, and with a subjective evaluation base (I like it; I don't like it) as the objective (good fit).

Once the garments have been finalised and the order has been sent through for mass-production, the images previously stored and approved will serve as a reference base for the quality assurance service which will use them as standards for evaluating the manufacturing achieved by the producer. In the case of a dispute, the same process can be used as a communication tool for discussing defects appearing on the garment correctly placed on the mannequin which has been approved as such.

This being the case, it is clear that the final key to success when a garment is chosen is based on the favourable opinion of the consumer. In an age where communication is widely available through the internet and rapid response is common practice, there is a need for systems which enable any new product under development to be modelled directly in 3D on a mannequin before being mass-produced. There is also a need for systems which can be used by the designer of a particular label to represent the morphology of the target consumer, to test the market and gather reactions and comments from the consumers, with a view to defining the right product to manufacture corresponding to the requirements of this specific group of consumers. The applicant's GVS claims to provide a global response to the problems mentioned above.

Following the previous development it is found that the principles governing the mastery of good fit for garments and the facilities provided for communication between the different parties involved in the garment supply chain result in the implementation of a process which will be described in detail in connection with FIGS. 1, 2, 3, and 4.

FIG. 1 is a general flow diagram showing the four main steps of the process carried out in the GVS.

The first step 1, known per se, results in the parallel provision, in the profile and size under examination, of a specific virtual mannequin (SVM) in 3D and a specific physical mannequin (SPM) 2 which are strictly identical, and perfectly representative of the morphology of the target consumer.

The second step is a step 3 of acquiring data. It uses the techniques of photography and simulation associated with the process.

The third step 4 merges the data acquired during the previous step.

Finally, during the fourth step 5 the data are viewed, archived and distributed using a specific document format adapted for the clothing industry the GDF format (garment document format).

At the start of the first step 1, the designer of the label and the product manager define the body silhouette regarded as representative of the target consumer to be supplied. The industrial practice commonly used to obtain the precise profile and dimensional measurements of this representation is based on selecting a live model 6 corresponding most closely to this definition (the SHM, specific human mannequin). A more scientific approach comprises using the information collected after a specific morphological search by scanning the target population, the data organised as a function of their key parameters for categorising the human body profile (ethnic group, sex, stature, weight, measurements, attitude, and body posture) within a morphological databank 7, 8 such as the one developed by the present applicants, and selecting the target profile. It is also possible to scan the live mannequin 6 used as a "model" by means of a three-dimensional digitisation system 9,10 and to store the above mentioned essential data for categorising the body profile.

Starting from these precise bases for defining the target body, a virtual human representation is used to which the patented process known as "cyber fit" of deformation/expansion on a computer 11 is used to fill in completely and precisely the volumetric space defined by the cloud of dots, specific to the selected category of human body profile (obtained from the database 7,8) whilst simultaneously correcting any asymmetry and showing the key lines (the "red lines") for garment design obtained from selected measurement data and body attitude/posture data regarded as essential in the matter of garment design.

Therefore the GVS has a specific virtual representation of the target body (the SVM, specific virtual mannequin) which is fully parametric. By using another process and apparatus 12 patented by the present applicants it is possible to obtain to scale 1 a physical representation made of resin which is strictly faithful to the virtual representation, the SPM 2(specific physical mannequin)on which the reference "red lines" appear. This mannequin SPM 2 is fitted with a hook for attachment to a suspension system 13.

Once this SPM 2 has been approved by the designer of the label and by the product manager, from the body profile of the SVM regarded as the reference size the GVS uses an automatic measuring and size developing system to construct rationally the other sizes in accordance with the dimensional measurements required by the label by displaying the "red lines" (more than 40 key measurement lines and key parameters of attitude and posture which define the body profile). All these measuring values correspond to the body profile representative of the consumer and are identical for the SVM and SPM 2 being "modelled" from the same data.

During the second step 3, the process according to the invention uses as the viewing base, a method of photographic shooting of the naked SPM 2, the clothed SPM 2 and merging them with the SVM, allowing interactive communication in order to monitor correct construction, good fit and the details of manufacture of the garment under discussion.

Because the definition of the mannequin SPM and SVM are strictly identical, the 3D "red lines" created on the SVM can be transferred, using a special programme, to 2D photographs of the SPM both naked and clothed.

Figure 2:
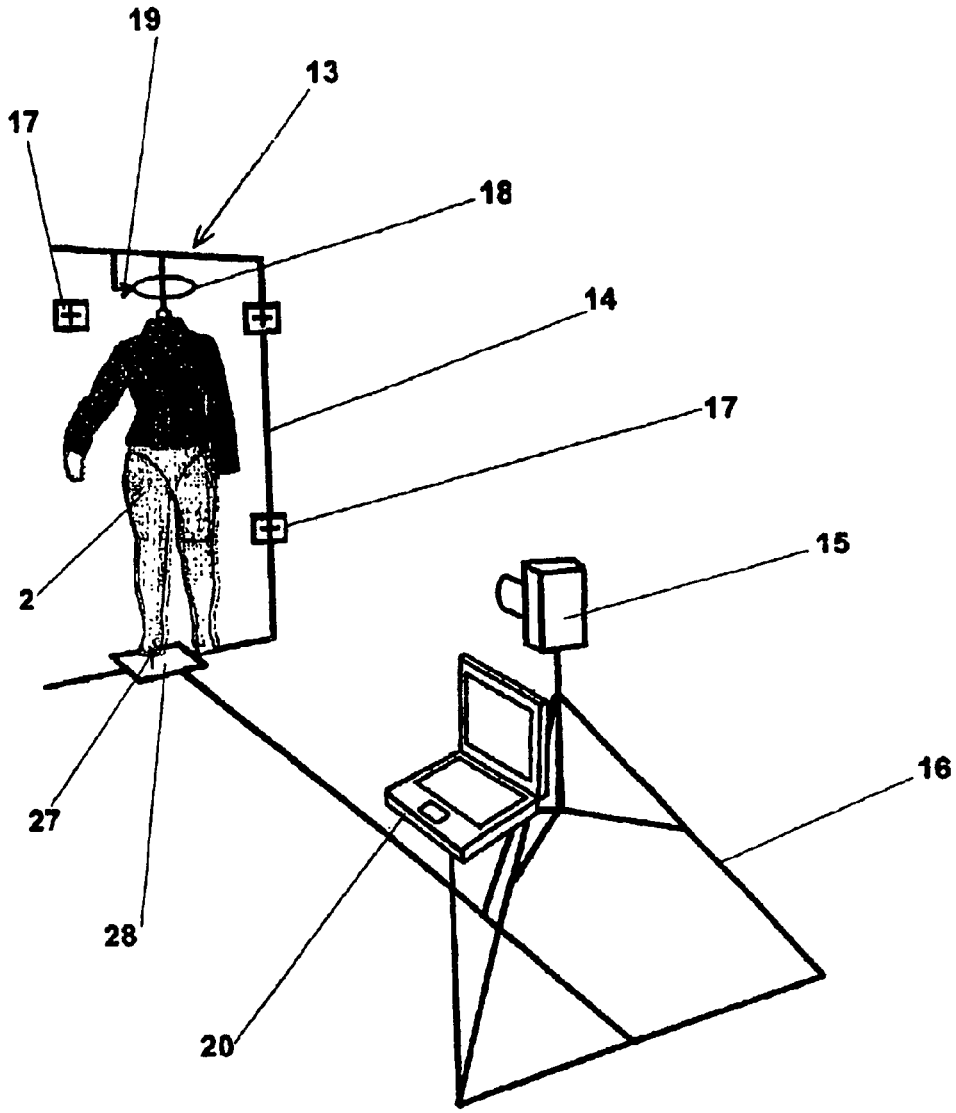
FIG. 2 is a diagrammatic view of the digital shot system used to implement the process according the invention.

The different stages of this method are as follows (see FIGS. 2, 3, and 4).

The garment to be examined is placed on the SPM 2, suspended from a support 14, and is photographed with a digital camera 15 placed on a metal frame 16, the distance of which from the support 14 is adjustable so to obtain correct photographic focusing. The support 14 has positioning points 17 for a fixed focus.

The digital camera 15 can take a series of shots of this SPM 2 naked or clothed in different regularly spaced radial directions. In order to do this the suspension means 13 of the SPM 2 comprises a notched disk 18 and a locking member 19 which allows a series of angular movements of 30° over a global rotation of 360°.

The twelve digital images of the naked SPM are taken in the twelve positions and transferred to the micro computer 20 used to control the camera 15. The data corresponding to these images stored in the computer system 21 constitute the first viewing layer of the SPM of the label within the databank 22, 23 of the GVS system.

The garment is then placed on the SPM and photographed in the same way. The position markers 17 incorporated in the construction of the support 14 and positioned on the uprights are used to adjust the fixed-focus photographic equipment 15.

A number of individual details may be added to the SVM by simulation on the computer system 21 in accordance with the body profile of the SPM 2 and some of the visual features of the target population (hair type and colour, skin type and colour) in order to give the desired appearance to the fashion mannequin according to the definition of the label. Once this has been agreed it is called the specific virtual fashion mannequin (SVFM) and will be used as such to show the garments on screen to both buyers in the industry and external customers 24, 25, 26.

The data corresponding to all twelve images in the twelve positions of the specific virtual fashion mannequin (SVFM) constitute the second layer of viewing of the mannequin (SVFM). The clothed SPM is merged with the SVFM on the computer system 21 to display a viewable clothed SVFM mannequin. When the garments are placed on the mannequin 2, all twelve positions can be viewed for a subjective evaluation.

The whole of this step for achieving a usable result requires a great deal of precision both in the relative positioning of each element in the photographic booth (mannequin 2, camera 15) and on the other hand the correct positioning of the garment to be examined on the naked body of the SPM 2 or on the clothed mannequin, with or without the previous layer.

The following should be taken into account in particular: the physical height of the mannequin 2, the distance between the bottom and the digital photographic equipment 15, the focal distance of the photographic equipment 15, the orientation of the photographic equipment 15, the resolution of the image captured and the predetermined dimensions of the CCD sensor.

Using the following equation the ratio "number of pixels of the photo/physical unit" is programmed into the computer 20. In order to do this:

let:

d=the distance between the SPM 2 and the camera 15, f=the focal distance of the camera 15, cw=the physical width of the CMOS sensor, ch=the physical height of the CMOS sensor, iw=the width of the photo, ih=the height of the photo, pw=the width of the physical space captured by the photo, ph=the height of the physical space captured by the photo, h=the height of the physical mannequin 2 in mm, r=the ratio 1 of pixels per physical unit in mm, spmh=the height of the mannequin SPM 2 in number of pixels, and from these are calculated:

a) The physical space captured by the photo:

$$pw=d\times cw/f$$

$$ph=d\times ch/f$$

b) The ratio between one pixel and the number of physical units:

$$r=ph/ih$$

c) The number of pixels representing the height of the SPM 1:

$$spmH=h\times ih/ph$$

The GVS asks users to define the base point and three reference points in the photo space in order to fix the position of the base point of the SPM 2, the frame of the booth 14 and the particular space to be photographed. Correct positioning of the SPM 2 is determined by the similarity between the spmH and the base point.

During the shooting of the naked SPM 2, the GVS needs additional data to ensure the standard position of vertical orientation. This is obtained by placing a laser source 27 below the legs of the SPM 2.

Figure 3A:
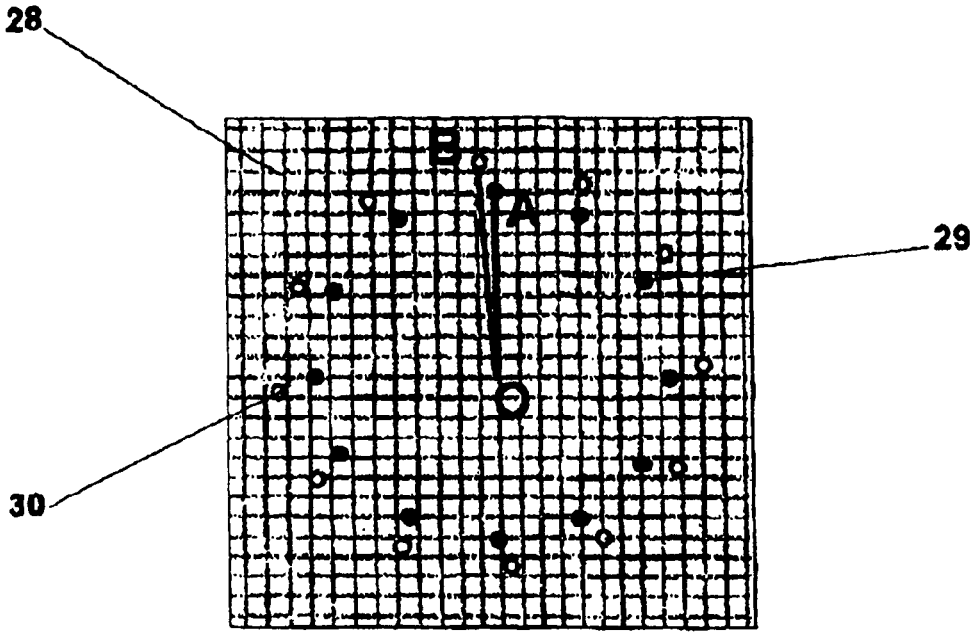
FIGS. 3*a* and 3*b* diagrammatically show the process for ensuring correct positioning of the garment on the mannequin.
Figure 4:
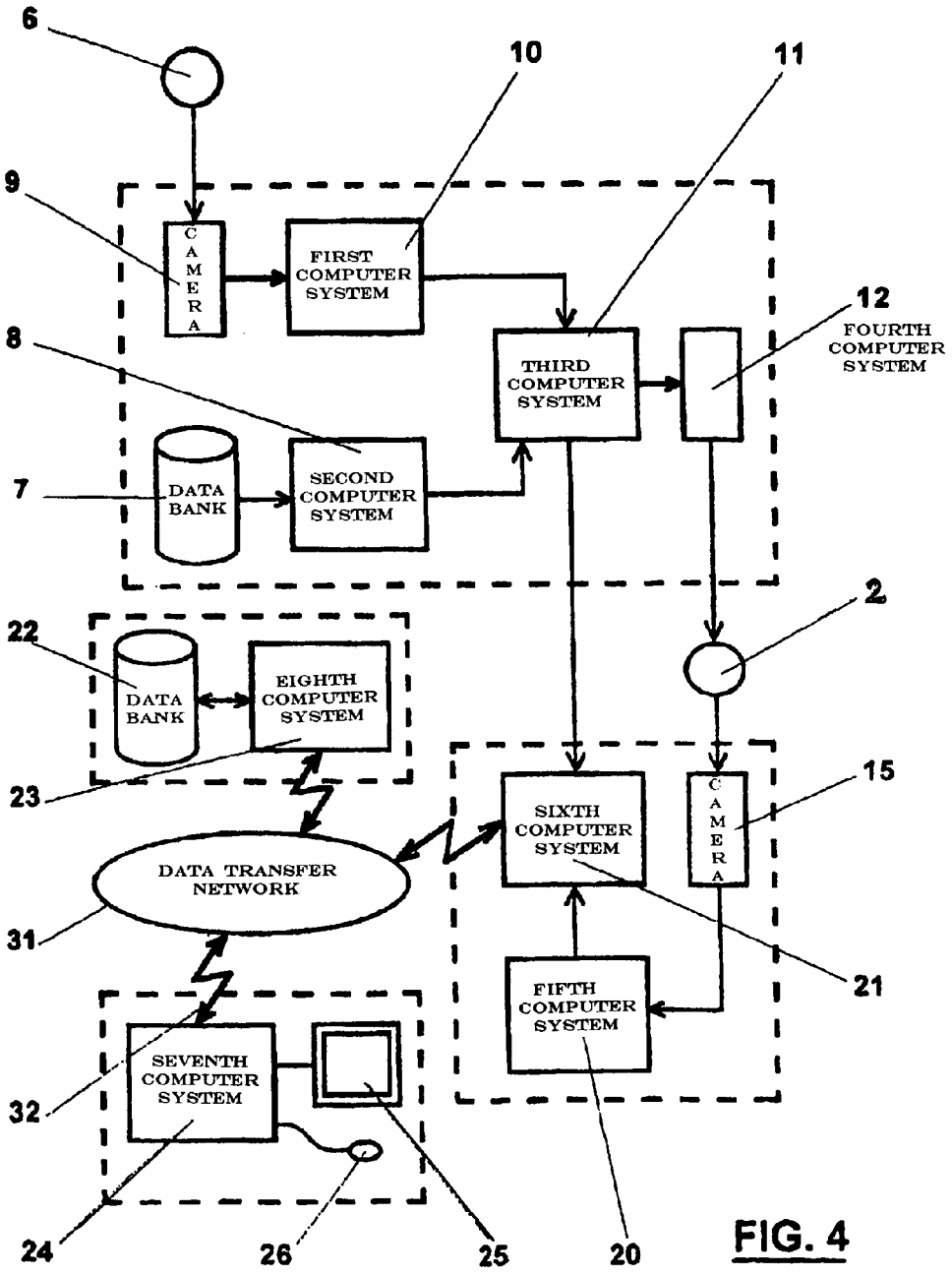
FIG. 4 diagrammatically shows the computer structure of the device for viewing, archiving, and transmitting a garment model over a computer network according to the invention.

A series of standard positions will be stored during the shooting of the mannequin 2 as it rotates according to the embodiment shown in FIG. 3*a*.

In order to achieve a perfect merging of the images, the photograph of the garment must be altered to achieve the correct scale, orientation, and position.

In order to do this, the procedure of lining up the base reference point 0 enables the garment to be moved into the correct position on the SPM 2.

Knowing the height of the clothed mannequin and the height of the SPM 2, the correct scale correction factor can be determined.

The traces 29, 30 of the laser beam 27 every 30° help to fix the correct orientation of the garment. They are arranged in two concentric circles the centre 0 of which is the trace of the rotation axis ZZ' of the mannequin 2 on the horizontal plane of the sensor. The angular spacing AOB between a radius OA of the circle corresponding to the positions of the naked SPM 2 (black dots) and the adjacent radius OB of the circle corresponding to the positions of the clothed mannequin 2 (white dots) is shown in FIG. 3*a*.

Figure 3B:
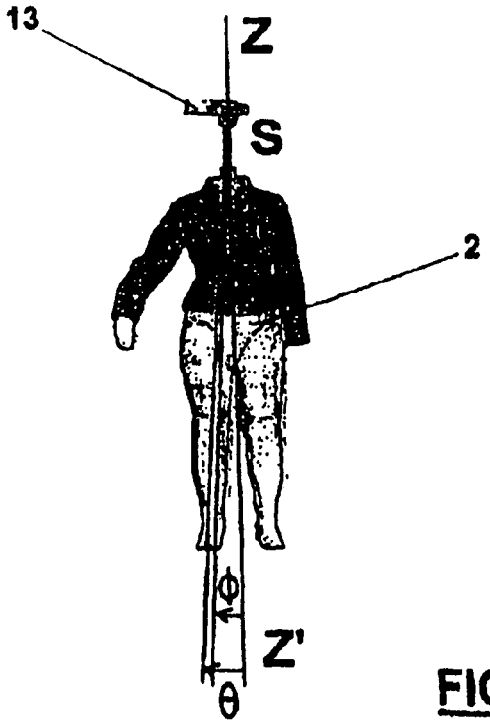

When the standard SPM 2 and the clothed SPM 2 have the same suspension point S, the orientation distance $\vartheta-\Phi$ shown in FIG. 3*b* can also be calculated:

$\vartheta$ is the angle formed by the laser beam and the central axis ZZ', calculated by the formula $\vartheta$=Arc tg (dmq/h) wherein dmq corresponds to the distance between the laser beam of the clothed mannequin 2 and the central axis ZZ' and h is the height between the base of the leg and the pivot point s in physical units;

$\Phi$ is the angle formed by the laser beam and the central axis ZZ', calculated by the formula $\Phi$=Arc tg (dSPM/h) wherein dSPM is the distance separating the laser beam of the naked mannequin 2 from the central axis ZZ' and h is the height between the base of the leg and the pivot point S in physical units.

The precise merging of the images occurs during the third step 4, taking into account corrections of scale, position and orientation.

As the SPM 2 is obtained from a mould taken from the SVM, both incorporate the "red lines" and identical dimensional measurements and parameters of attitude and posture. The reference red line of the upper section of the body and the reference red line of the lower section (or the chest line and hip line) act as positioning and marking points for the images of the SVM to be merged with those of the SPM, the clothed SPM and the clothed SVFM mannequin. These two base layers perform the following functions: the first base layer with its key reference points of construction and vertical alignment (the "red lines") is used for "objective analyses" (checking and comments relating to the design and manufacturing details). The second layer (the SVM fashion mannequin of the label) is used for "subjective analyses" (comments on the visual aspects, the aesthetic look of the style and added details of differentiation). Numerous types of garment can be super-imposed on the SPM 2. By using the "image processing programme GVS" the merged images will appear super-imposed exactly over one another, layer on layer. Each layer can be observed as a single garment worn by the SPM 2 with whatever degree of transparency (ranging from totally transparent to totally opaque), showing either the naked SPM 2 or the clothed SPM 2. Each layer can be observed in relation to the other layers. They may all be based on the reference points and lines of the dimensional measurements and key parameters of the primary layer of the SPM 2. By using the "studio" and GDF viewer, the designer or one of the parties involved can ensure that the garment is correctly positioned on the mannequin or on the previous layer (using the "red lines" for reference and vertical alignment), check the dimensional measurements, particularly with the AMS system (automatic measurement system), examine the garment from any one of twelve viewing angles, with any desired degree of transparency showing either the SPM 2 naked with the "red lines" (construction and vertical alignment lines), or the garment being worn by the SPM 2 with or without the "red lines". The space between the garment and the SPM 2 can be observed and measured in order to ensure a correct fit (for ease and comfort) and to ensure that this design and size correspond to the specifications of the designer both objectively, in terms of measurements, and subjectively, in terms of appearance.

The method of merger is as follows.

Because the SPM 2 is obtained from a mould taken from the SVM, the two have identical parameters of dimension, attitude and posture. The top and bottom reference points of the body—chest measurement and hip measurement—are used as marks for merging the SVM with the SPM 2, the clothed SPM 2 and the SVFM fashion mannequin.

The "red lines" are imported onto the SPM 2. By matching up the positioning marks of the body on the SPM 2, merger is possible. The positioning of the SPM 2 on the photographic area can also be correctly positioned by means of tabs 17 of the structure forming part of the construction of the viewing support 14, 16. This makes it easier to focus the camera and marry up the distances. A light source 27 emitting a laser beam in a substantially vertical direction is placed at the base of a foot of the SPM 2. A horizontal matrix sensor 28 is arranged underneath the structure 14 to detect the position of the points of light 29, 30 produced by the impact of the laser beam. Any deviation of the SPM 2 from a standard position can thus be corrected by the software in order to re-establish a perfect alignment.

Using the positioning references for the body and the viewing reference points 17, of the light beam transmitter 27 and the light-sensitive plate 28, the SVM is re-framed, reoriented and precisely merged with the SPM 2.

Personalising details are added to the merged SVM in order to display the second layer on the SVFM fashion mannequin.

Using a special programme on the computer system 21 to detect the unclothed part from the clothed part of the SPM 2, the clothed part—the garment to be examined—can be extracted. The combined assembly chosen will be composed by merging different garments on the SPM 2 or on the SVFM fashion mannequin constituting a combined assembly for visualisation.

The final result is a view of the garment worn by the SVFM for subjective control of the aesthetic appearance and fit.

The merging step is based first of all on photographing the different layers using the photographic techniques described above to ensure correct positioning, orientation, and scale, the assembly going from the base surface (naked SPM 2) to the final layer of clothing.

In order to allow viewing with different degrees of transparency/opacity of the different layers which may be combined, the individual final value in pixels after combining is stored in the computer according to the following equation:

Where p1=value in pixels of the layer 1,
o1=degree of opacity as a percentage of the layer 1
p2=value in pixels of the layer 2,
o2=degree of opacity as a percentage of the layer 2,
pr=result given in pixels, the equation is:

$$pr=p1\times o1+p2\times o2$$

The phase of transferring the "red lines" onto the photos of the SPM 2 uses the following techniques:

a) After the specific human mannequin 6 (SHM) has been digitised, the 3D coordinates are automatically transferred into the automatic measurement system (AMS), the coordinates of the "red lines" and the measurement values are generated and stored in a file (file of "red lines" specifications) according to the following structure:
   The first line of the file INT is meaningless and to be disregarded.
   From the second to the last line each line structure will be:
   x1 Y1 z1 x2 y2 z2 number_ID
   wherein (x1, y1, z1) and (x2, y2, z2) are the coordinates of the origin and end of the segment whose ID number is "ID number".
   All the segments corresponding to a measurement must have the same ID number (the line segments with an ID greater than 50 should not be displayed and are used solely to display the definition of the measurement), b) starting from the red line data, the system is capable of indicating the vertical median line and all the "red lines" of the body. The number ID 1 appearing in the "red lines" corresponds to the height of the head, the number ID 4 being the total height of the red line of the body. On the basis of this information the system is capable of calculating the height of the neck, c) once the photo of the SPM 2 has been focused the median line of the photo located underneath the suspension point must be strictly vertical. The height of the SPM 2 from the point of suspension to the base of the legs is known from the data, d) Additional information is needed, the height of the neck of the SPM 2, e) The positioning of the red line data on the photos of SPM 2 is determined in relation to the median line. The scale of the red line data is determined by the ratio between the height of the neck of the SPM 1 and the height of the neck of the "red lines" of the body.

f) once the position and scale have been adjusted, the red line data can be super-imposed onto the photo of the SPM 2.

The automatic measurement method of the intra-layer space at any point is based on precisely determining the ratio of "number of pixels in the photo/number of physical units" which can be found using the following equation:

where:

d=distance between the SPM 2 and the camera 15, f=focal length of the camera 15, cw=physical width of the sensor CMOS, ch=physical height of the sensor CMOS, iw=width of the photo, ih=height of the photo, pw=width of the physical space captured by the photo, ph=height of the physical space captured by the photo, h=height of the physical mannequin in mm, r=ratio of one pixel per physical unit in mm, spmh=height of the mannequin in pixels, the equation determining the physical surface which can be captured by the photo is:

$$pw=d\times cw/f$$

$$ph=d\times ch/f$$

the ratio between one pixel and the physical unit being:

$$r=ph/ih$$

The positioning of the mouse on the zoomed part of the image triggers the counting of the number of pixels, the reading of the result being calculated by the computer 21 according to the plan:

where:

dm=the distance to be measured between two points, dp=the distance between the two physical objects, in the equation:

$$dp=dm\times r.$$

Finally, during the last step 5 of the process according to the invention, the GVS is presented as a natural additional aide to the parties involved in the supply chain, enabling them to access the various documents, databases and communications which can be related to the images being inspected with regard to the orders and requests for information. Thanks to the GDF document format, the GVS makes available the multiple article files required for the different objectives and ensures that the process is continuously monitored to enable better comprehension and accessibility. All the functions of the GVS are grouped in a number of software modules constituting the GDF organiser:

GDF Studio,

GDF Viewer,

GDF Catalogue,

GDF Editor.

This latter module also allows the process plan to be edited for the management contacts. It helps all the management level to organise any garment under development.

The GDF organiser is as described below.

The GDF Studio and Viewer are an application for creating and accessing the elements of the GDF article file (enquiries relating to the garment or orders for the garment). On the basis of a garment being worn by the SPM 2, comments can be recorded directly in the GDF documents. They serve as a reference, trace, recording and basis for interactive communication.

Using the GDF Studio, different SPMs wearing the same garment or the garment combined with others can be viewed.

The Studio and the GDF Viewer allow the users to visualise the dimensional relations between the garment and the body by specifying the different degrees of transparency. The different users can then use this visualisation to set up interactive discussions relating to the "fit" of the garment being studied.

The GDF Catalogue is a tool for discovering and scrolling through the information contained in the GDF databank.

The GDF Editor is a tool for publishing the GDF Catalogue totally or partially by means of the web server and providing a consultation basis for the users of this web catalogue.

The GDF diagram is a system of interactive communication based on the definition of the specific role of the parties involved in the particular processes of the garment supply chain. It takes the form of a privileged office tool which can be used to gain full knowledge of the advance of a step regarding each specific function carried out by each particular service. This advance is monitored by a series of advancing grids suitable for each specific function carried out, allowing the process to be viewed.

Depending on the work that is to be done, the user selects the corresponding advancing grid. The specific monitoring plan for each step is introduced into the GDF document once it has been created. The diagram facilitates interactive communication within the GDF Organiser.

The different parties involved in the garment supply chain need to record different information in different documents at different times during the production process. The users may need to record different fabrics and tables of measurements. They may also need to issue intermediate reports for each step. The GDF helps to manage the overall process by ensuring that the quality, quantity, rapid response and satisfaction of the customer are studied, recorded, and monitored.

The GDF API (application program interface) is a tool for extracting detailed information and specifications in response to a request submitted in respect of a garment or following an order to be discussed through the GDF Studio and Viewer via the XML analysts and interpreters (Extended Markup Language).

The GDF Organiser gathers information through API application interfaces and XML interpreters. Consequently, the user can call up this system in order to find out about various documents. The basic GDF includes specifications relating to materials (fabrics, supplies), garment patterns, tables of measurements, databases, worksheets, etc. detailing the orders and requests of the customer in relation to the specific garment.

The information relating to materials on "material.com" (a material website) is retrieved by means of the API and XML translators via the GDF Organiser.

Through the GDF Studio and Viewer a user can call up the GDF links. This will put them in contact with the numerous systems which frame the specifications and details of the order and requests regarding the garment. These systems include "material.com" for the materials and supplies incorporated and "artwork.com" for embroidery, prints and manufacturing details. They also suggest the "colour palette" for defining the shades.

The GDF Organiser also provides a certain number of developmental buttons defined by the customer. The purpose of these is to assist the user in defining the fashion accessories, the elements which make up the garment, etc. There is also an optional developmental toolbox for helping the user with their numerous requests.

It is clear from the foregoing that GDF is a universal information filing structure. The GDF Organiser, as part of the GVS using the SHM, the SPM 2, the clothed SPM 2 and the representation of the clothed SVFM fashion mannequin, assists in the visualisation and the communication of key information relating to the garment or the order. Users can store all the data from all the parties to the garment supply chain relating to the garment in the GDF files. They can exchange the data included in the GDF through e-mail or the FTP (File Transfer Protocol).

Thus, users via the GDF Studio and Viewer, the GDF Catalogue, the GDF Editor and the GDF Diagram can reassure themselves as to the feasibility conditions, for the garment under observation, objectively by:

- the availability on screen or in a printed copy of the full list of each key point of design and dimensional measurement, parameters of attitude and posture of the SPM 2, corresponding measurements of the garment (according to the layer being observed), the spacing between layers (ease of fit or stretch),
- enlargement (zoom) of detailed views at any point,
- sizing at any specific part of the garment in order to observe the detail of the supplies, work, and manufacturing techniques,
- the sizing of a specific reference line in order to obtain the measurements of the garment and the corresponding measurements of the SPM, and subjectively by:
- mixing and putting together different types of garments stored in the "GDF Databank" 22, 23 in order to create a design as a first approximation or in order to dress the SVFM in order to check proper marketing, and adding options by:

- calling up, via the button bar, special options and details of personalising and differentiating the garment (sub-assemblies, supplies, colour palette, designs and prints, embroidery) with the possibility of positioning them on the garment precisely as desired, communicating and inter-reacting by

- making available, to the different parties involved, the actual interactive communication facilities (requests for clarification from the designer or anyone else, comments, requests for alterations and immediate checking of the results). This is to ensure that, in the course of the stages of development of the product, the product is finally obtained in a form suitable for mass production at the right price, within the desired time frame and with the desired quality, storing the resulting images by:
- the ability to store the images in the "GDF Databank" once the correct design of the garment has been approved, by mixing, blending, coordinating and superimposing the GVS images by:

- the use of the "GDF Catalogue" in order to manipulate all the images of a specific line of garments created by the same designer with those obtained of other garments approved by the designer. These images in the GDF format can be merged layer on layer and observed relatively in relation to one another owing to the fact that they all tally at the same key measuring points and reference lines (the "red lines" of construction and vertical alignment) appearing on the SPM 2, in testing and analysing the commercial appeal of the garments by:

- transmitting the approved prototype sample from the designer's studio (the virtual sampling room) with its images in GDF format to the selection committee (designer and product managers). It may also be sent for sample test marketing (consumers and distributors) using an internet market survey before any decision is taken on production, ensuring that transmission is security-protected by:

- the creation of firewall systems and safety mechanisms to prevent any unidentified or unauthorised intrusion in the transmission of any image, information, comments, technical files (such as list of components with indications of the quantities required and sources; assessment of costs) via the internet-intranet-extranet to any other computerised system.

The GVS provides an integrated universal system for communicating and visualising any garment product presented on the body of the profile provided, specific to the supply chain of the clothing industry. It supplies critical data relating to details of style, design and pattern-cutting, fit, manufacture and marketing to the key players involved in this process. Through a person-to-person communication link or a link from one person to a number of others, the GVS provides an effective interactive method of sharing the computerised information relating to the garment product. This innovation makes it easier to manage the product data and to take a fast, joint decision by interactive communication, reduces delays and misunderstandings between the parties involved and contributes to greater productivity, reduced costs, and higher satisfaction for everyone involved in the garment supply chain.

The essential advantages of this tool are:

- the ability to rely on an SPM or SVM in order to view and inspect any kind of garment intended for a specific market on a physical mannequin and a virtual mannequin which are absolutely identical in their measurements, attitudes, and postures and are perfectly representative of the target group of specific consumers,
- the ability to simulate a series of reference lines of dimension or measurements—the "red lines" of the AMS (Automatic Measuring System)—starting from the SVM in 3D, towards identical 2D photographic reproduction of the SPM 2 derived from it,
- the ability to take and use digital photographs in order to present any garment or fashion item on a specific physical mannequin (SPM mannequin 2) or on a virtual mannequin specific to the label (SVM or SVFM), with the precise measurements and on the exact scale, without any deformation of the product being viewed, the capacity, with the GDF Studio and Viewer, to photographically record, view, and store the images of the SPM 2 at 360° with a precise interval every 30° and to use these as the first base layer for any objective viewing of the garment in the GVS, the capacity to digitally simulate the images of the SVM or SVFM fashion mannequin over 360° with a precise interval of 30°, in a horizontal plane, as an exact replica of the positioning and dimensions of the images of the SPM, and to use these as a second base layer for all the subjective viewing of the garment with the GVS, the ability to study the garment shown on the SPM 2 or on the SVM or the SVFM fashion mannequin with various degrees of transparency, from totally transparent (in which only the base SPM is visible) to totally opaque (showing only the garment displayed on the SPM) and with any desired degree of transparency between the two extremes. In this operation the fit of the garment can be inspected by studying the garment in relation to the key points and reference lines (the "red lines" of dimensional measurement) marked on the base SPM 2 or on the SVFM fashion mannequin by measuring the gap between the garment and the SPM 2. The key points of manufacture and quality can be evaluated objectively and subjectively by the observer, the ability to view electronically, independently of the place and distance, via the internet-intranet-extranet, the sample prototype shown on the dedicated specific physical mannequin 2, (SPM) or the specific virtual fashion mannequin (SVFM) in order to carry out a general and detailed critical examination—both objective and subjective—(with possible use of the zoom function) of the manufacturing details which make a difference to the quality level and the differentiation of commercial appeal, the possibility of matching up and storing the multiple data relating to a garment product in various specific identifiable files and of consolidating in a universal tool—the GDF Database 22, 23 all the information and key images linked with the details of this specific garment. All the parties involved in the garment supply chain can share the results through this interactive technology, the possibility of zooming onto any component category of the garment using the mouse 26 of the computer 24 and of forming a link with the data files 22, 23 by intranet, extranet or internet 31 and communication means 32, regarding:

materials through the site "material.com" or through the material data files of the Company, the fabric, the supplies, the finishing elements through the website "artwork.com" or by the finishing data files of the company:

the designs, the embroidery, the special effects, manufacture by the website "apparelmanufacturing.com" or through the manufacturing process data files of the company, the garment elements, the stitching, special treatments, pattern boards by direct access to the design systems conventionally used such as the Gerber system and Lectra system, the buttons in the individualising option box containing for example:

the garment components, the dimensions required, the colour range, the care instructions, the ability to pick up all the opinions and comments by all the parties involved regarding a garment prototype relative to any modifications which have to be made to this specific garment design before any decision to mass-produce it is made through the GDF Organiser. The fact that it is possible to offer a precise view of the product during the developmental stage makes it easier to apply the "rapid response methods" in order to reduce delays. The use of electronic means facilitates discussion and decision making irrespective of the physical location of all the parties. This is done at virtually zero cost and has substantial economic advantages in terms of improving productivity (savings on materials and time), improvements to the quality of the product (clear, complete, and precise specifications accompanied by preventive quality control) and better management for out-sourcing, the ability to mix and match the viewed garment samples with other types of garment (provided that these garments have been created and photographed on the same SPM 2) with the aim of coordinating them and ensuring that they work and have appeal, the ability to precisely superimpose these different garments, presented on the same SPM 2, layer on layer, captured photographically, and to study each layer with any desired degree of transparency to ensure compatibility in terms of fit and comfort, the ability to transmit and search, through the GDF Organiser, (via the servers), at remote locations and with controlled authorisation (for security), images and data with the possibility of exporting these images and data by the use of physical copies, file transfer by e-mail, FTPs, the ability to use the GDF process plan to assist in communication and access to all the electronic files linked with the GVS, the ability to enhance consumer market testing with regard to the acceptability and commercial appeal of a specific garment style before it is mass produced, the ability, by its structure, to protect the entire system from unidentified and unauthorised intrusion so as to safeguard the intellectual property rights of any design and know-how temporarily or permanently stored by GVS.

The method and apparatus for viewing, archiving and transmitting a garment model according to the invention over a computer network therefore appear to be tools which have numerous advantages owing to the fact that the steps of inspecting, monitoring, finishing, seeking to individualise and personalise prototypes of models by a label are facilitated by a process system which is precise, easy to understand and use, instead of being based solely on the traditional approach of a live mannequin with all the attendant imperfections. The live type of mannequin can change measurements over time (becoming fatter or thinner) and is generally more or less asymmetric. The body profile displayed may therefore conform or not conform to all the dimensional and parametric conditions of the label, while it should be as close as possible for greater customer satisfaction. Moreover, the live mannequin cannot be extrapolated to every size in the range but can only be defined by means of a table of measurements within the range of sizes which are to be produced. Finally, although the live mannequin may be representative, in the size under examination, of the profile and measurements of a specific target population for whom the garments are intended, they are obviously not valid for other targets even though the garment models created may also be intended for them and should be equally satisfactory for them.

The garment visualisation system GVS offers the possibility for each specific sales target—and over the entire range of sizes intended—of objectively and subjectively ensuring "good fit and comfort" by the use of a viewing tool for inspecting the garment which is intended for mass production, modelled on specific physical mannequins for the target profile (SPM) and on a specific virtual mannequin (SVM) or a specific virtual fashion mannequin (SVFM) which are strictly representative in their symmetrical expression of the human morphology which is to be addressed.

To this end, the GVS comprises a system for viewing and communication which enables any party involved in the garment supply chain, regardless of their location and distance, to access, discuss, alter and correct the process applied to the definition, to the finishing and the acceptance of a given product, by visualising the prototype sample (as mass production samples) for any desired size, while ensuring the good fit, the correctness of the measurements and their actual production. This is all possible thanks to the fact that the sample garment being studied (or intended for mass production) can be examined (simultaneously or after a delay, by all the parties required to make a decision) on a fashion mannequin which is specific to the intended target, in the desired size, in double representation strictly identical in both physical and virtual form. This viewing can be done in various states of transparency, on the naked fashion model and on the virtual fashion model defined by the label as a function of each target customer group, in relation to the other layers of clothing worn, to ensure both comfort, fit, and also the "look".

All the images and data thus obtained through the GVS can be electronically transmitted, stored in the computerised memory, and security-protected.

As will be apparent, the invention is not restricted simply to the preferred embodiments described above. On the contrary, it encompasses all possible alternative embodiments.

The invention claimed is:

1. A method of viewing, archiving, and transmitting a garment model over a computer network, said method comprising the steps of:

a) acquiring on a first computer system (10) a three-dimensional view of a specific human mannequin (6) having pre-determined morphological features, extracting from this three-dimensional view first data for categorizing a human physical profile, and storing said data, b) alternatively extracting said first data from a databank (7) in a second computer system (8), c) generating, on a third computer system (11), second data representing a three-dimensional specific virtual mannequin from said first data, d) automatically manufacturing, from said second data, using a fourth computer system (12), a specific physical mannequin (2), wherein said method comprises acquiring, from a fifth computer system (20), a first view of said specific physical mannequin (2) and representing said first view by means of third data corresponding to said first view.

2. The method of viewing, archiving, and transmitting a garment model over a computer network according to claim 1, wherein said method further comprises acquiring from said fifth computer system (20) a second view of said specific physical mannequin (2) wearing a garment, and recording said second view by fourth data corresponding to said second view.

3. The method of viewing, archiving, and transmitting a garment model over a computer network according to claim 2, wherein said first and second views comprise a plurality of two-dimensional images of said specific physical mannequin (2) in a plurality of regularly spaced radial directions.

4. The method of viewing, archiving, and transmitting a garment model over a computer network according to claim 3, wherein said two-dimensional images comprise a recording of grid reference points (17) for fixed-distance digital recordings.

5. The method of viewing, archiving, and transmitting a garment model over a computer network according to claim 3, wherein said two-dimensional images comprise a recording of vertical and horizontal reference lines.

6. The method of viewing, archiving, and transmitting a garment model over a computer network according to claim 5, wherein a first layer is subtracted by means of reference points (17), said lines or signals in a sixth computer system (21) from fourth data representing said specific physical mannequin (2) wearing a garment for forming a two-dimensional model of said garment, in each of said directions.

7. The method of viewing, archiving, and transmitting a garment model over a computer network according to claim 6, including the step of processing said model on said sixth (21) or a seventh computer system (24, 25, 26) for displaying a second layer as a transparency.

8. The method of viewing, archiving, and transmitting a garment model over a computer network according to claim 3, wherein spatial positioning signals of said specific physical mannequin (2) are recorded simultaneously when said first and second views are taken.

9. The method of viewing, archiving, and transmitting a garment model over a computer network according to claim 3, wherein a second two-dimensional base layer is generated on a sixth computer system (21) from fifth data by simulating a shot taken in said directions.

10. The method of viewing, archiving, and transmitting a garment model over a computer network according to claim 9, including the step of merging said model by means of reference points (17), lines or signals on said sixth (21) or a seventh (24, 25, 26) computer system with said second layer for producing a two-dimensional view, in each of said directions, of a clothed specific virtual fashion-mannequin for facilitating assessment of said garment.

11. The method of viewing, archiving, and transmitting a garment model over a computer network according to claim 1, wherein said second data are personalized on a sixth computer system (21) using visual characteristics of the type and color of hair and skin, for obtaining fifth data representing a three-dimensional specific virtual fashion-mannequin.

12. The method of viewing, archiving, and transmitting a garment model over a computer network according to claim 11, wherein a first two-dimensional base layer of said first view is extracted from said sixth computer system (21) for said first view.

13. The method of viewing, archiving, and transmitting a garment model over a computer network according to claim 12 wherein first and second layers and said model are transmitted to a seventh computer system (24, 25, 26) by means of a data transfer network (31) according to a pre-determined communication protocol for displaying the model shown on a specific virtual fashion-mannequin or on said specific virtual mannequin.

14. The method of viewing, archiving, and transmitting a garment model over a computer network according to claim 13, including the step of storing said first and second layers and said model in a data base (22) on an eighth computer system (23) which is accessible by means of a data transfer network (31) in accordance with a pre-determined communication protocol for displaying said model shown on said specific virtual fashion-mannequin or on said specific virtual mannequin.

15. The method of viewing, archiving, and transmitting a garment model over a computer network according to claim 14 wherein each recording of said data base (22) is associated with at least one recording of a first, second, third and fourth file containing data relating to material, accessories, manufacture and patterns.

16. The method of viewing, archiving, and transmitting a garment model over a computer network according to claim 14 wherein a plurality of garment models corresponding to the same specific virtual mannequin are displayed layer on layer with a selected degree of transparency.

17. Apparatus for viewing, archiving, and transmitting a garment model over a computer network adapted for carrying out the method according to claim 16, said apparatus comprising:

a) means (9) connected to a first computer system (10) for digital recording of a specific human mannequin (6), b) first processing means and first storage means associated with said first computer system (10) for extracting and storing first data for categorising a human body profile relating to said specific human mannequin, c) alternatively, second processing means and second storage means associated with a second computer system (8) for extracting said first data from a data bank (7), d) third processing means and third storage means associated with a third computer system (11) for generating second data representing a specific virtual mannequin, e) a digitally controlled system for manufacturing three-dimensional objects connected to a fourth computer system (12) comprising fourth processing means and fourth storage means, for manufacturing a specific physical mannequin (2) from said second data, further comprising a system for taking digital pictures (15) for recording images of said specific physical mannequin (2) unclothed or wearing the garment, said system for taking digital pictures (13, 14, 15, 16, 17, 27, 28) being connected to a fifth computer system (20) equipped with fifth processing means and fifth storage means for the purpose of representing said specific physical mannequin (2) unclothed or clothed, by third and fourth data, respectively, corresponding to said images.

18. Apparatus for viewing, archiving, and transmitting a garment model over a computer network according to claim 17, wherein said system for taking digital pictures (13, 14, 15, 16, 17, 27, 28) comprises grid reference points (17) in the plane of the specific physical mannequin (2).

19. Apparatus for viewing, archiving, and transmitting a garment model over a computer network according to claim 17, wherein said system for taking digital pictures (13, 14, 15, 16, 17, 27, 28) comprises a detector for detecting position (28) of a light beam emitted by a light source (27), fixed to the specific physical mannequin (2).

20. Apparatus for viewing, archiving, and transmitting a garment model over a computer network according to claim 17 wherein said system for taking digital pictures (13, 14, 15, 16, 17, 27, 28) comprises an orienting device (13) for orienting the specific physical mannequin (2) in a plurality of regularly spaced radial directions.

21. Apparatus for viewing, archiving, and transmitting a garment model over a computer network according to claim 20, wherein said orienting device (13) comprises a notched disc (18) having twelve notches and a locking member (19) engaging in one of said notches.

22. Apparatus for viewing, archiving, and transmitting a garment model over a computer network according to claim 17, wherein said system for taking digital pictures (13, 14, 15, 16, 17, 27, 28) comprises a fixed-focus digital photography apparatus (15) provided with a matrix CCD sensor.

23. Apparatus for viewing, archiving, and transmitting a garment model over a computer network according to claim 17, wherein said apparatus further comprises:

a) a sixth computer system (21) provided with sixth processing means, sixth storing means, viewing means, and transmission means capable of processing and storing said second, third and fourth data for generating, viewing and transmitting a two-dimensional model of said garment, and viewing layers of said specific virtual mannequin and of a clothed specific virtual fashion-mannequin with a variable degree of transparency, b) a seventh computer system (24, 25, 26) provided with receiving means, seventh processing means, seventh storing means, and display means for receiving said model and the layers, and displaying said model, and generating and displaying said specific virtual mannequin and the clothed specific virtual fashion-mannequin with a variable degree of transparency, c) an eighth computer system (22, 23) provided with communication means, eighth processing means, and eighth storing means, for the purpose of receiving, transmitting and archiving a plurality of said model and said layers associated with complementary data files, including data relating to material, accessories, manufacture, and patterns, d) a data transfer network (31) connecting said sixth (21), seventh (24, 25, 26) and eighth (22, 23) computer systems, including a network for accessing the internet.

24. Apparatus for viewing, archiving, and transmitting a garment model over a computer network according to claim 17, including security means for controlling access to the contents of a storage means.

25. Use of the process and apparatus for viewing, archiving, and transmitting a garment model over a computer network according to claim 17, wherein said use provides crucial information relating to details of style, design, and patterning of said garment, of good fit, manufacture and marketing to key participants involved in processes specific to a garment supply chain.

26. Use of the process and apparatus for viewing, archiving, and transmitting a garment model over a computer network according to claim 25, wherein said use creates an effective interactive way of sharing computerized information relating to said garment through a communication link from one person to another, or from one person to a number of people.

27. Use of the process and apparatus for viewing, archiving, and transmitting a garment model over a computer network according to claim 25, wherein said use assists in management of product data and in fast, joint decision-making by interactive communication, reduces delays and misunderstandings between parties involved and contributes to higher productivity, reduced costs, and greater satisfaction for each person involved in said garment supply chain.

28. Use of the process and apparatus for viewing, archiving, and transmitting a garment model over a computer network according to claim 27, wherein said use relies for inspection and checking of any kind of garment intended for a specific market, on a specific physical mannequin (2) and on a specific virtual mannequin which are strictly identical in their measurements, attitudes, and postures, and perfectly representative of a specific consumer target group.

29. Use of the process and apparatus for viewing, archiving, and transmitting a garment model over a computer network according to claim 25, wherein said use allows electronic viewing, irrespective of place and distance, through the internet or an intranet-extranet (31), of said garment displayed on a dedicated specific physical mannequin (2) or on a specific virtual fashion-mannequin for allowing a general and detailed, objective and subjective, critical inspection and, with possible recourse to a zoom function, of manufacturing details which make a difference in terms of quality and commercial appeal.

30. Use of the process and apparatus for viewing, archiving, and transmitting a garment model over a computer network according to claim 25, wherein said use makes it possible to link and store a range of data relating to said garment in various specific identifiable files and for consolidating in a database (22) all information and key images associated with details of said garment.

31. Use of the process and apparatus for viewing, archiving, and transmitting a garment model over a computer network according to claim 25, wherein said use makes it possible to check into any category or component of said garment with a mouse (26) of a computer system (24, 25, 26) and to establish a link with data files via an intranet-extranet or the internet (31), relating to:

a) materials, via a first dedicated web site or via a company's material data files particularly relating to fabric supplies, b) added-value elements, via a second dedicated web site, or via a company's added-value data files particularly relating to designs, embroidery, and special effects, c) manufacturing, via a third dedicated website or via a company's manufacturing process data files particularly relating to garment components, stitching, assembly techniques and measurements, d) pattern boards, via direct access to design systems conventionally used, and e) buttons of a customizable box of options relating to components, supplies, designs, embroidery, and color palette.

32. Use of the process and apparatus for viewing, archiving, and transmitting a garment model over a computer network according to claim 25, wherein said use provides for gathering opinions and comments of parties involved concerning a garment relative to any alterations which have to be made to a specific design of said garment before any decision is taken regarding mass production, said use making it easier to apply a rapid response method for reducing delays, and said use offers substantial economic advantages in terms of improving productivity, potential savings in materials and manufacturing time, improvements to quality of the product, by means of clear and precise specifications allowing preventive quality control and improved management for outsourcing.

33. Use of the process and apparatus for viewing, archiving, and transmitting a garment model over a computer network according to claim 25, wherein said use enables viewed samples of the garment to be mixed and matched with other types of garment, created and photographed according to said process and apparatus.

34. Use of the process and apparatus for viewing, archiving, and transmitting a garment model over a computer network according to claim 25, wherein said use enables different types of the garment which can be combined to be superimposed, displayed on said specific physical mannequin (2), layer on layer, recorded photographically and for studying each layer with any desired degree of transparency for ensuring compatibility in terms of fit and comfort.

35. Use of the process and apparatus for viewing, archiving, and transmitting a garment model over a computer network according to claim 25, wherein said use provides for transmitting and searching images of said garment and data at long distance and with controlled authorization with the possibility of exporting said images and data using physical copies for file transfer.

36. Use of the process and apparatus for viewing, archiving, and transmitting a garment model over a computer network according to claim 25, wherein said use enhances consumer market testing with regard to the acceptability and commercial appeal of a specific style of said garment or combinations chosen.

* * * * *